US006758076B1

(12) United States Patent
Åsén

(10) Patent No.: US 6,758,076 B1
(45) Date of Patent: Jul. 6, 2004

(54) DEVICE FOR LOCKING A DOOR ELEMENT IN AN OPENING TO A SPACE

(75) Inventor: Sten Åsén, Gustavsberg (SE)

(73) Assignee: Lockia Sakerhetsteknik AB, Varmdo (SE)

( * ) Notice: Subject to any disclaimer, the term of this patent is extended or adjusted under 35 U.S.C. 154(b) by 0 days.

(21) Appl. No.: 09/979,455

(22) PCT Filed: May 10, 2000

(86) PCT No.: PCT/SE00/00929

§ 371 (c)(1),
(2), (4) Date: Jan. 16, 2002

(87) PCT Pub. No.: WO00/70173

PCT Pub. Date: Nov. 23, 2000

(30) Foreign Application Priority Data

May 14, 1999 (SE) ..... 9901753
Jan. 21, 2000 (SE) ..... 0000180

(51) Int. Cl.[7] ..... E05B 63/00

(52) U.S. Cl. ..... 70/417; 70/94; 292/338; 292/259 R

(58) Field of Search ..... 70/94, 134, 95, 70/91, 417, 416, 418; 292/259 R, 260, 338, 339, 346, 288, 289

(56) References Cited

U.S. PATENT DOCUMENTS

| | | | | |
|---|---|---|---|---|
| 430,072 A | * | 6/1890 | Dowd | 70/417 X |
| 2,066,705 A | * | 1/1937 | Vazquez | 70/74 |
| 2,261,353 A | | 11/1941 | Fedele | 70/120 |
| 3,377,094 A | | 4/1968 | Thompson | 292/346 |
| 3,792,885 A | * | 2/1974 | Giardina et al. | 292/259 R X |
| 3,821,884 A | * | 7/1974 | Walsh | 70/95 |
| 4,491,354 A | * | 1/1985 | Williams | 70/417 X |
| 4,852,373 A | * | 8/1989 | McGough | 70/417 |
| 5,010,747 A | | 4/1991 | Norden, Jr. | 70/94 |
| 5,131,189 A | * | 7/1992 | Mascotte | 70/417 X |
| 5,709,111 A | | 1/1998 | Henao | 70/104 |
| 5,730,014 A | | 3/1998 | Berger et al. | 70/422 |

FOREIGN PATENT DOCUMENTS

| | | |
|---|---|---|
| DE | 197 27 878 | 1/1999 |
| FR | 2 533 961 | 9/1982 |
| FR | 2 669 072 | 5/1992 |

* cited by examiner

*Primary Examiner*—Suzanne Dino Barrett
(74) *Attorney, Agent, or Firm*—Swidler Berlin Shereff Friedman, LLP

(57) ABSTRACT

The present invention relates to a device for locking a door element (1*a*) in an opening to a space. The device comprises an operating member (2) arranged outside this space, which member (2) is arranged to allow, by a motion transmission mechanism, displacement of a locking bar (6), arranged inside the space, between a first position when the locking bar (6) allows an opening of the door element (1*a*) and a second position when the locking bar (6) connects the door element (1*a*) to a second element (1*b*) such that opening of the door element (1*a*) is prevented and a lock (3) allowing locking of the locking bar (6) in said second position. A protective housing (5) is arranged to encase the locking bar (6) and the parts of the lock (3) and the motion transmission mechanism that are arranged inside the space.

12 Claims, 4 Drawing Sheets

DEVICE FOR LOCKING A DOOR ELEMENT IN AN OPENING TO A SPACE

TECHNICAL FIELD OF THE INVENTION AND PRIOR ART

The present invention relates to a device for locking at least one door element in an opening to a space, wherein the device comprises an operating member arranged outside the space, which is arranged to allow, by a motion transmission mechanism, displacement of a locking bar, arranged inside the space, between a first position when the locking bar allows an opening of the door element and a second position when the locking bar connects the door element to a second element such that an opening of the door element is prevented and a lock allowing locking of the locking bar in said second position.

By a door element is meant a door, cover or the like which may be used for closing an opening to a space of an arbitrary kind. In many cases, locking devices for door elements usually are countersinked in recesses provided in the door element. Such recesses result in that the original thickness of the door element and thereby the strength decreases in that area, which is utilised by thieves.

Other kinds of locking devices are arranged outside the door element. Such locking devices may, for example, comprise a locking bar which has one end attached to the door and a second end, which may be fixedly locked to a rigid wall element adjacent to the door, for example, by means of a pad lock. Such locking devices may easily be broken to open, for example, by a hydraulic cutter which has the capacity to cut of steel with a thickness of up to 15 mm. Alternatively, one end of a heavy wire may be attached to the locking bar and the second end to a vehicle, whereafter the vehicle may pull out the locking bar.

Locking devices, which substantially have its locking mechanism arranged on the inside of a door element, provides the best protection against burglary from the outside. However, these locking devices do not eliminate the risk that a thief hides inside or enters a space, which, for example, may be a storage space or a container. Thereafter, the thief may dismount the locking device from the inside. Alternatively, the thief may enter, for example, a storage room, via a window, with the purpose of from the inside dismounting the locking device to facilitate the possibility ton take out the stolen goods.

FR 2 533 961 shows a locking device having a locking mechanism provided on the inside of a door. The rotary motions of an operating member on the outside of the door are transmitted, in this case, to a rotary motion of a gear wheel on the inside of the door. The rotary motions of the gear wheel are transmitted to a displacement motion of a locking bar, via a toothed surface provided thereon, between a door blocking and a not blocking position. A lock is arranged to lock the locking bar in the blocked position. In order to control the displacement motions of the locking bar, metal plates are provided, which are so shaped that they form rectangular channels in which the locking bar is displaceably provided. One such metal plate is arranged on the inside of the door and another on the inside of an adjacent wall. In order to attach these inwardly provided metal plates, corresponding external metal plates are provided on the outside of the door and on the outside of said adjacent wall. These external metal plates comprise fixed soldered bolts extending through the door and the adjacent wall and through holes in the internal metal plates. Thereafter, nuts are provided on the threaded portions of the bolts in order to fix the internal metal plates to the inside of the door and the adjacent wall and thereby said guide channel of the locking bar. For a thief hidden at the inside of the door, it is very simple to screw off said nuts and to disengage the internal metal plates and thereby the locking bar. Furthermore, the gear wheel and the lock are unprotected against attacks from the inside of the door.

SUMMARY OF THE INVENTION

The object of the present invention is to provide a device for locking a door element such that it becomes very difficult for a thief to force the locking device both from the outside and from the inside of the door element.

This object is achieved by the initially mentioned device which is characterised in that it comprises a protective housing which is arranged to encase the locking bar and the parts of the lock and the motion transmission mechanism that are arranged inside the space. By such a protective housing covering sensible parts of the device, attacks on these parts are considerably more difficult. Preferably, the protective housing is manufactured of thick hardened steel. Another advantage by protecting said substantially moveable parts of the device, is that one prevents the internal locking mechanism from being blocked by unfixed goods provided in the space, which may be the case, for example, in a container.

According to a preferred embodiment of the present invention, the protective housing is attached to at least one internal wall surface of the space. Thereby, the protective housing may obtain an uncomplicated and stable fixation. Preferably, the protective housing is attached to said internal wall surface by means of a non-dismountable attachment means. Thereby, it is essentially more difficult for a thief to dismount the protective housing from the inside in order to reach and break open the locking mechanism. Such non-dismountable attachment means may be bolts having heads which preferable are countersinked in a mounted state and having such a shape that they are difficult to grip. Such non-dismountable attachment means may also comprise rivets or welding.

According to another preferred embodiment of the present invention, the protective housing comprises a channel in which the locking bar is displaceably provided. Such a protective housing thereby also may work as guiding element to the locking bar. The protective housing may comprise at least two separate parts and that a first part of the protective housing is attached to an internal wall surface and that the second part of the protective housing is attached to an internal wall surface of said second element. Since the locking bar extends between the door element and the second element, it is suitable that the protective housing is arranged as two separate parts. However, the parts of the protective housing will lie close to each other in the closed position of the door element so that they form a continues channel so that the locking bar may be displaced to its second position. Alternatively, the protective housing may be provided as a single part, which is attached to the door element or the adjacent element. The second element may comprise a second openable door element or a rigid wall element. When double door elements are used, the two door elements may be locked together by the locking bar. For a single door element it is suitable that the locking bar locks the door element in relation to an adjacent rigid wall element.

According to another preferred embodiment of the present invention, it comprises coupling means, which is arranged to restrict the force, which the operating member, via the motion transmission mechanism, is allowed to transmit to the locking bar. Thereby, the risk is prevented that a thief by suitable tools from the outside provides a such a heavy force onto the operating member that the locking bar is displaced and deforms the locking mechanism. Such coupling means may comprise a suitable kind of safety clutch. Advantageously, the motion transmission mechanism is arranged to transmit a rotary motion of the operating member to a reciprocal displacement motion of the locking bar. Preferably, the operating member is a rotateable wheel or crank arranged on the outside of the door element. The operating member is connected to a suitable motion transmission mechanism which transforms the rotary motion of the operating member to a reciprocal motion of the locking bar between said first and second position. Preferably, the motion of the locking bar is linear.

According to another preferred embodiment of the present invention, the locking bar has a front portion provided in a displacement direction, said front portion comprises at least one chamfering. By such a chamfering, the risk is eliminated that the locking bar tilts and jams during the displacement motion in the channel. Especially when the protective housing consists of two pieces and the channel is divided, such a chamfering brings about that the parts of the channel are centred to a desired position in relation to each other during the displacement motion of the locking bar.

According to another preferred embodiment of the present invention, the lock comprises a bolt, which is insertable in a recess in the locking bar in order to lock the locking bar in said second position. Preferably, such a lock comprises a lock body extending through the door. On the outside of the door element, a key activates the lock so that the bolt, which is provided on the inside of the door, is displaced in or out of said recess. Preferably, the lock is a 9-lever tumbler lock. Such a lock is a high security lock, which is approved to be used in safes. The key of the lock is protected against an unauthorised copying. Furthermore, the lock has a barrier, which prevents insertion of optical means for photographing the inside with the purpose of manufacturing an unauthorised key.

According to another preferred embodiment of the present invention, the device comprises a protecting plate arranged outside the space for covering at least a part of a slit provided between the door element and said element, which part of the slit the locking bar internally extends passed in its second position. Preferably, such a protecting plate has an extension along the slit, which at least corresponds to the width of the locking bar. By such a protecting plate, it is made more difficult for a thief to insert a cutting tool in the slit with the purpose to cut off the locking bar.

BRIEF DESCRIPTION OF THE DRAWINGS

In the following, preferred embodiments of the invention are described as examples with reference to the attached drawings, in which.

DETAILED DESCRIPTION OF PREFERRED EMBODIMENTS OF THE INVENTION

Figure 1:
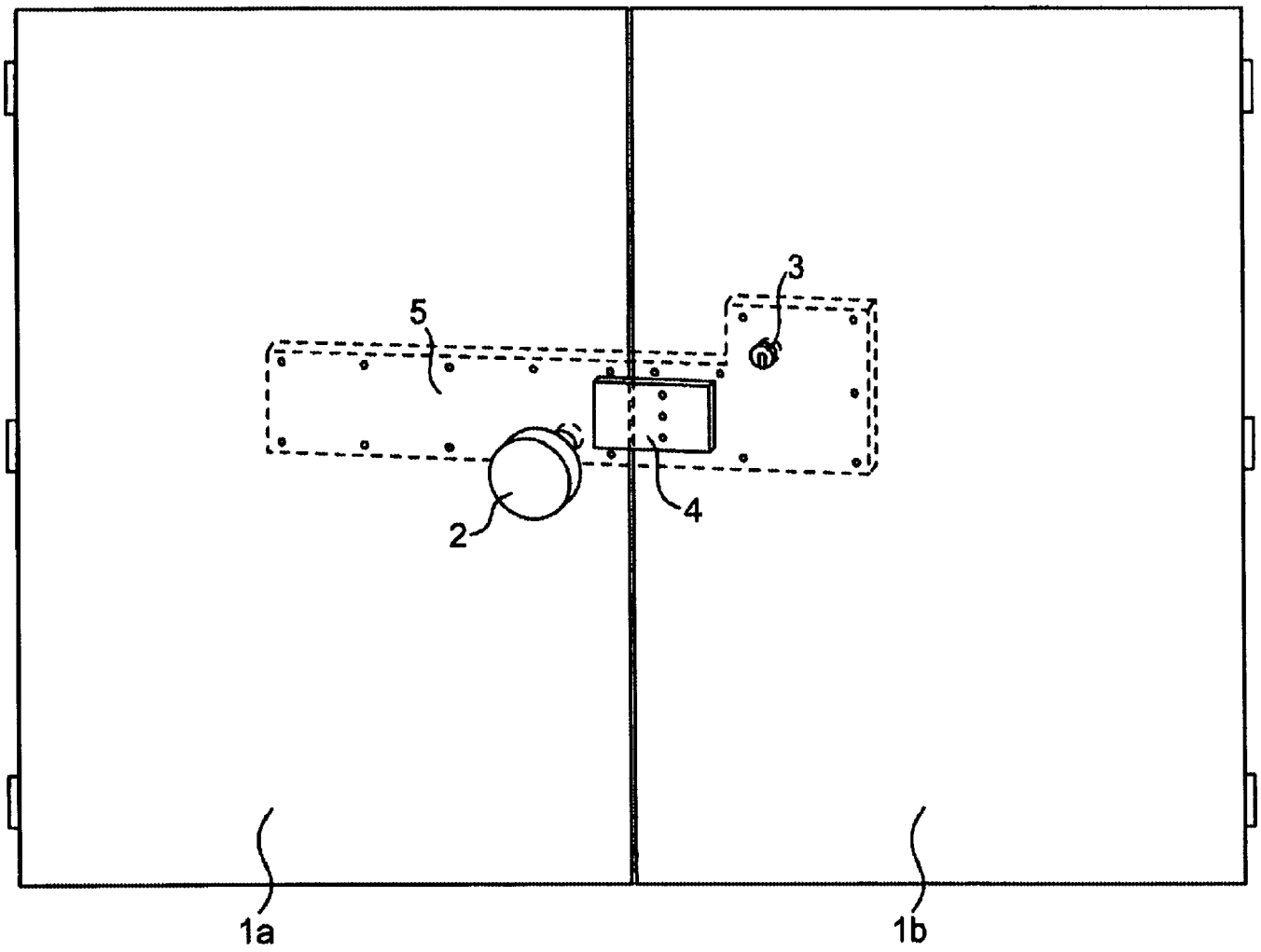
FIG. 1 shows, from the outside, two pivotally arranged door elements having a locking device according to the present invention.

FIG. 1 shows from the outside first 1*a* and second 1*b* pivotally arranged door elements. Said door elements 1*a, b,* may, for example, be used to cover and lock an opening to, for example, a space in a container. A turnable operating member 2 is arranged on the outside of the door element 1*a* by which a user is allowed to operate a locking mechanism arranged on the inside of the door element 1*a,* 1*b*. The operating member 2 may also be used as a handle in order to open and close the door element 1*a*. The second door element 1*b* comprises a lock 3 of which a front portion having a keyhole is visible from the outside of the door element 1*b*. A protecting plate 4 is fixedly provided on the outside of the door element 1*b* by a suitable attachment means. The protecting plate 4 has an extension so that it covers a part of the slit between the door elements 1*a,* 1*b*. The object of the protecting plate 4 is to make it more difficult to insert cutting tools in the slit in order to cut off the internally provided locking mechanism. By the fact that the locking mechanism is located substantially on the inside of the door elements 1*a,* 1*b,* it is very difficult for a thief to break open the door elements 1*a,* 1*b* in a locked state. By dashed lines in FIG. 1 is shown a protective housing 5 arranged on the inside of the door elements 1*a,* 1*b,* which is arranged to protect the locking mechanism arranged on the inside of the door elements 1*a,* 1*b*.

Figure 2:
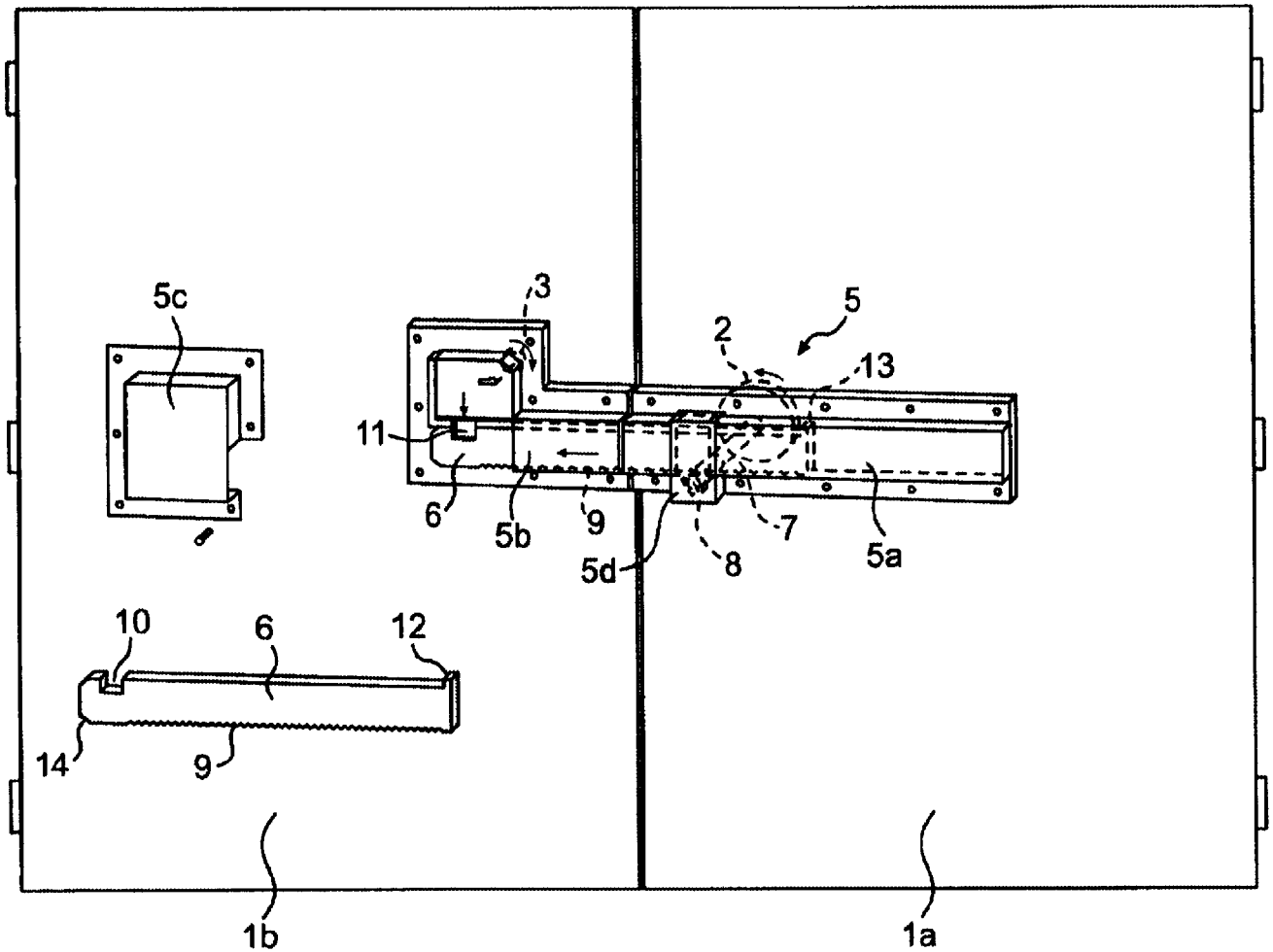
FIG. 2 shows, from the inside, said door element having a locking device according to a first embodiment.

FIG. 2 shows from the inside of the space the first 1*a* and the second 1*b* pivotally arranged door elements. The protective housing 5 is arranged to encase that part of the locking mechanism, which is provided internally of the space. The protective housing 5 comprises a first part 5*a* which is attached to the inside of the door element 1*a* and a second part 5*b* which is attached to the inside of the door element 1*b*. The protective housing 5 comprises a base plate with which it is attached to the inside of the respective door element 1*a*, 1*b* by special bolts. Such special bolts have a head shape, which minimises the possibility to get a grip of them with tools. Alternatively, other non-dismountable attachment methods may be used, for example, the base plates may be welded or attached by rivets to the inside of the door elements 1*a,* 1*b*. Except for the base plate, the protective housing 5 comprises a portion disclosing an inner cavity in which the locking mechanism is encased. This cavity comprises in this case a channel having a rectangular cross sectional profile. Certainly, the channel may have an arbitrary cross sectional profile adapted to the cross section of a locking bar 6 which is displaceably provided in the channel. The locking bar 6 is also shown as a separate unit in FIG. 2. The locking bar 6 is displaceable between a first position where the locking bar 6 only is located in a channel part, which belongs to the first part 5*a* of the protecting housing and a second position where the locking bar 6 extends into a channel part, which belongs to the second part 5*b* of the protective housing. Thereby, the locking bar 6 connects the door elements 1*a*, 1*b* to each other so that they cannot be opened. The displacement of the locking bar 6 is obtained by a turning of the operating member 2, which is placed on the outside of the door element 1*a*. The turning motions of the operating member 2 are transmitted to a linear displacement motion of the locking bar 6 by a motion transmission mechanism. The motion transmission mechanism comprises a shaft 7 connected to the operating member 2 which transmits the turning motion of the operating member 2 to a gear wheel 8. Between the shaft 7 and the gear wheel 8 a safety clutch is provided. The rotary motion of the gear wheel 8 is transmitted, by a toothed pattern 9 provided to the locking bar 6, to a linear reciprocal motion of the locking bar 6. The locking bar 6 comprises a recess 10 located straight below the lock 3 in the second position of the locking bar 6. The lock 3 comprises a displaceable bolt 11, which is insertable in the recess 10 in order to lock the locking bar 6 in said second position. In order to position the locking bar 6 in said second position, the locking bar 6 comprises a stop lug which is arranged to get into engagement with a stop member 13 when the locking bar 6 reaches the second position. Consequently, in a locked position the locking bar 6 is not operable with the operating member 2. By the safety clutch, which preferably is a friction clutch, the force the operating member 2 may provide to the locking bar 6 is restricted. Thereby, the lock 3 cannot be deformed by providing a very heavy force on the locking bar 6 by means of the operating member 2. The protective housing 5 comprises also a part 5*c* which is arranged to encase that part of the lock 3 which is located on the inside of the door element 1*b*. Finally, the protective housing 5 comprises a part 5*d*, which encases the gear wheel 8. Consequently, the protective housing 5 encases all the moveable parts of the locking mechanism which are arranged on the inside of the space which makes it very difficult to manipulate or deform the locking mechanism from the inside and the outside of the door elements 1*a*, 1*b*. The front portion of the locking bar 6 has chamfering portions 14. By such chamferings 14, the risk that the locking bar 6 is tilted and jammed during the displacement motion in the channel is eliminated. Especially when the protective housing 5 is shaped into two parts and the channel divided, such chamfering 14 work to control the locking bar in the receiving channel part during the displacement motion of the locking bar 6. This is a great help if the door elements 1*a*, 1*b* have been warped.

Figure 3:
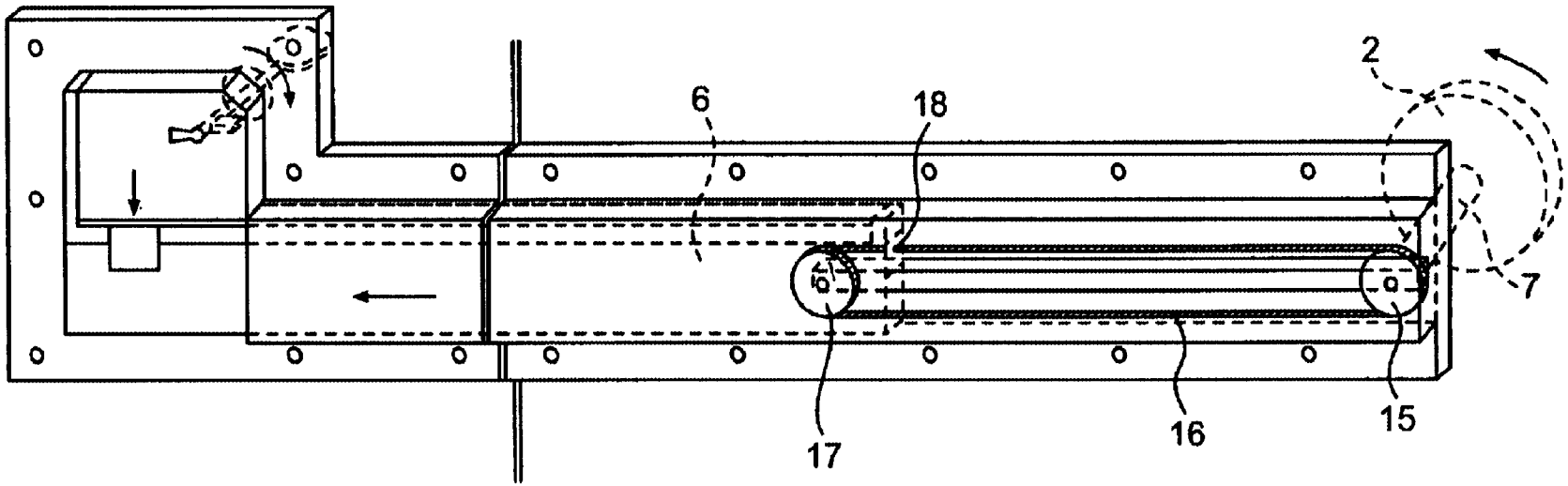
FIG. 3 shows, from the inside, said door element having a locking device according to a second embodiment

FIG. 3 shows an alternative embodiment of the motion transmission mechanism of the locking mechanism. In this embodiment the turning motions of the operating member 2 are transmitted, via the shaft 7, to a first pulley 15. The pulley 15 transmits its rotary motion to a cord 16. The cord 16 forms an endless loop, which except for said first pulley 15 also extend around the periphery of a second pulley 17. The second pulley 17 is fixedly carried in the protective housing 5. The cord 16 is fixedly attached in the locking bar 6 in an attachment 18. When the pulley 15 rotates, the cord 16 is displaced along said endless loop. Thereby, the attachment 18 in the locking bar 6 is displaceable between the positions of the pulleys 15, 17 and thereby brings the locking bar 6 between its first and second position. The locking bar 6 is partly hollow so that it may be moved to and back pass the second pulley 17 and partly encase the cord 16. Except that the operating member 2 in FIG. 3 has been moved somewhat sideways, the remaining parts of the locking mechanism correspond to the ones shown in FIG. 2. Alternatively, the pulleys 15, 17 may be replaced by a chain wheel and the cord 16 by a chain.

Figure 4:
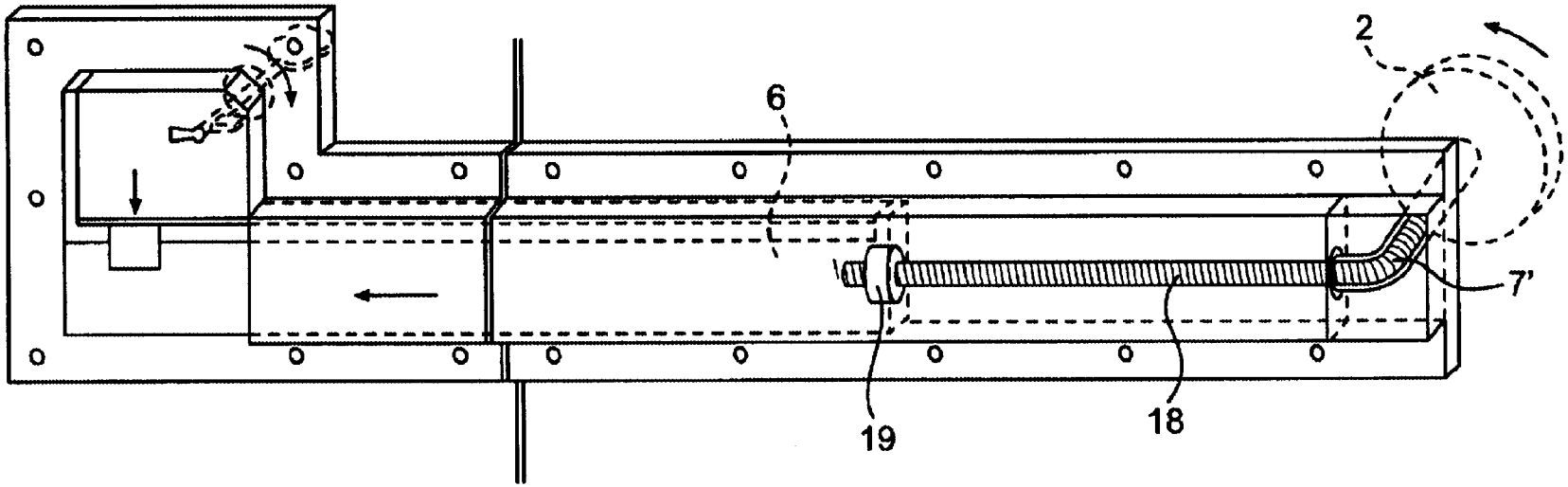
FIG. 4 shows, from the inside, said door element having a locking device according to a third embodiment.

FIG. 4 shows a further alternative embodiment of the motion transmission mechanism of the locking mechanism. In this embodiment, the turning motions of the operating member 2 are transmitted, via a flexible shaft 7', to a threaded rod 18. A nut 19 is fixedly provided in the rear end of the locking bar 6. By the rotary motion of the threaded rod 18, the nut 19 and the locking bar 6 obtains a reciprocal linear motion when the operating member 2 is turned. The locking bar 6 is also here partly hollow in order to allow the insertion of the threaded rod 18 during its displacement motion. The remaining parts of the locking mechanism in FIG. 4 correspond to the ones shown in 3.

As a further alternative, the motion transmission mechanism may comprise a worm gear for transmitting the turning motion of the operating member 2 from the shaft 7 to, for example, a threaded rod 18.

Preferably, the lock 3 shown in the figures comprises a 9-lever tumbler lock of the brand FAS. This lock is a high safety lock, which is approved for safes. Furthermore, the lock 3 has a built-in protection, which prevents insertion of fibre optical equipment. Thereby, photographing of the lock internally via the keyhole in order to produce a false key is prevented. The invention is not restricted to the embodiments described in the figures, but may be varied freely within the scope of the claims.

What is claimed is:

1. A device for locking at least one door element in an opening to a space, wherein the device comprises an operating member arranged outside the space, which member is arranged to allow, by a motion transmission mechanism, displacement of a locking bar, arranged inside the space, between a first position when the locking bar allows an opening of the door element and a second position when the locking bar connects the door element to a second element such that an opening of the door element is prevented and a lock allowing locking of the locking bar in said second position, characterized in that a protective housing is arranged to completely encase the locking bar and all the parts of the lock and the motion transmission mechanism that are arranged inside the space.

2. A device according to claim 1, characterized in that the protective housing is attached to at least one internal wall surface of the space.

3. A device according to claim 2, characterized in that the protective housing is attached to said internal wall surface by non-dismountable attachment means.

4. A device according to claim 2, characterized in that the protective housing comprises a channel in which the locking bar is displaceably provided.

5. A device according to claim 1, characterized in that the protective housing comprises at least two separate parts and that a first part of the protective housing is attached to an internal wall surface of the door element and that a the second part of the protective housing is attached to an internal wall surface of said second element.

6. A device according to claim 1, characterized in that said second element comprises a second openable door element or a rigid wall element.

7. A device according to claim 1, characterized in that the device comprises coupling means restricting the force, which the operating member, through the motion transmission mechanism, is allowed to transmit to the locking bar.

8. A device according to claim 1, characterized in that the motion transmission mechanism is arranged to transmit a rotary motion of the operating member to a reciprocal displacement motion of the locking bar.

9. A device according to claim 8, characterized in that the locking bar has a front portion provided in a displacement direction, said front portion comprises at least one chamfering.

10. A device according to claim 1, characterized in that the lock comprises a displaceable bolt which is insertable in a recess in the locking bar in order to lock the locking bar in said second position.

11. A device according to claim 1, characterized in that the lock comprises a 9-lever tumbler lock.

12. A device according to claim 1, characterized in that the device comprises a protecting plate arranged outside the space in order to cover at least a part of a slit provided between the door element and said element, which part of the slit the locking bar internally extends passed in a second position.

* * * * *